United States Patent [19]

Kageyama et al.

[11] Patent Number: 4,957,384

[45] Date of Patent: Sep. 18, 1990

[54] MECHANICAL PENCIL

[75] Inventors: Hidehei Kageyama; Yoshihide Mitsuya; Youichi Nakazato, all of Kawagoe, Japan

[73] Assignee: Kotobuki & Co., Ltd., Kyoto, Japan

[21] Appl. No.: 338,201

[22] Filed: Apr. 14, 1989

[30] Foreign Application Priority Data

May 15, 1988 [JP] Japan ..... 63-63545[U]

[51] Int. Cl.[5] ..... B43K 24/08; B43K 21/16

[52] U.S. Cl. ..... 401/65; 401/67

[58] Field of Search ..... 401/65, 67, 94, 116, 401/111, 110

[56] References Cited

U.S. PATENT DOCUMENTS

| | | | |
|---|---|---|---|
| 1,700,246 | 1/1929 | Woelm | 401/65 |
| 1,803,794 | 5/1931 | Deutsch | 401/65 |
| 2,056,143 | 9/1936 | Robbins | 401/65 |
| 2,210,845 | 8/1940 | Wahl | 401/65 |
| 2,222,295 | 11/1940 | Kanner | 401/65 |
| 3,664,753 | 5/1972 | Minagawa | 401/65 |
| 4,544,295 | 10/1985 | Hashimoto | 401/65 |

*Primary Examiner*—Richard J. Johnson

*Attorney, Agent, or Firm*—Sherman and Shalloway

[57] ABSTRACT

A mechanical pencil in which a lead guide pipe may protect a lead in a range from a lead chuck to the tip member or an extremity end of the slider by the tip member or the slider or the projection bar as well as the lead guide pipe so as to protect the lead and to prevent a breakage of the lead and a clogging of broken lead.

3 Claims, 6 Drawing Sheets

MECHANICAL PENCIL

BACKGROUND OF THE INVENTION

1. Field of the Invention

This invention relates to a mechanical pencil in which a lead is automatically fed under a releasing of a slider from a sheet or the like and the slider can be locked at its inner position when the pencil is not used.

2. Description of the Prior Art

In recent years, there has been proposed an automatic mechanical pencil capable of performing a knocking at its rear part having a so-called known one-way chuck type chuck device stored therein in which a lead is held when a writing pressure is applied and a chuck holding action for the lead is released when the lead itself is moved away from the chuck toward a writing extremity end by a resilient force of the slider and a friction applying part inserted into and fitted to the slider under a released writing pressure and then the lead is fed out.

However, any of the prior art pencils has some problems that an inner structure of a lead feeding mechanism or the like is quite complicated, an efficiency of assembling work is also inferior, a large number of component elements are required and a lead is pinched in a lead chuck when used and so a trouble often occurs.

In view of the above-described fact, the present applicant proposed a mechanical pencil in the past by filing Japanese Patent Application No. 62-94905 for a specific structure of the above-mentioned mechanical pencil.

According to this mechanical pencil, the inner structure could be relatively simplified, three types of lead feeding operations (an automatic writing, an extremity end knocking and a rear end knocking) could be carried out, a lock storing of the slider could be performed, a lead was fed out during a lead feeding operation through an extremity knocking action even in case of no projecting of the lead, and in turn, in case that the lead was excessively projected, the lead was not fed out, but only a cushion action was carried out.

Further, in case of a general type of knocking mechanical pencil in which a lead is fed out through knocking action, there was always present a space not covering a lead between a lead chuck for engaging with the lead and feeding-out it and a tip. Due to the presence of this space, it generated problems that a lead was broken or a lead was clogged with broken leads for the sake of no protection of the lead when an external force more than a desired amount was applied to the lead.

SUMMARY OF THE INVENTION

It is an object of the present invention to eliminate the above-described disadvantages of the conventional type of mechanical pencil and to provide a mechanical pencil in which a lead between an extremity end of the tip element or a slider and a lead chuck is covered or protected by both a projecting bar and a lead guide pipe so as to prevent a breakage of lead and a clogging of lead.

In order to accomplish the above-described object, the mechanical pencil of the present invention is made such that the lead guide pipe covering the lead is arranged between the tip element or the slider and the projecting bar.

DETAILED DESCRIPTION OF THE PREFERRED EMBODIMENTS

Figure 1A:
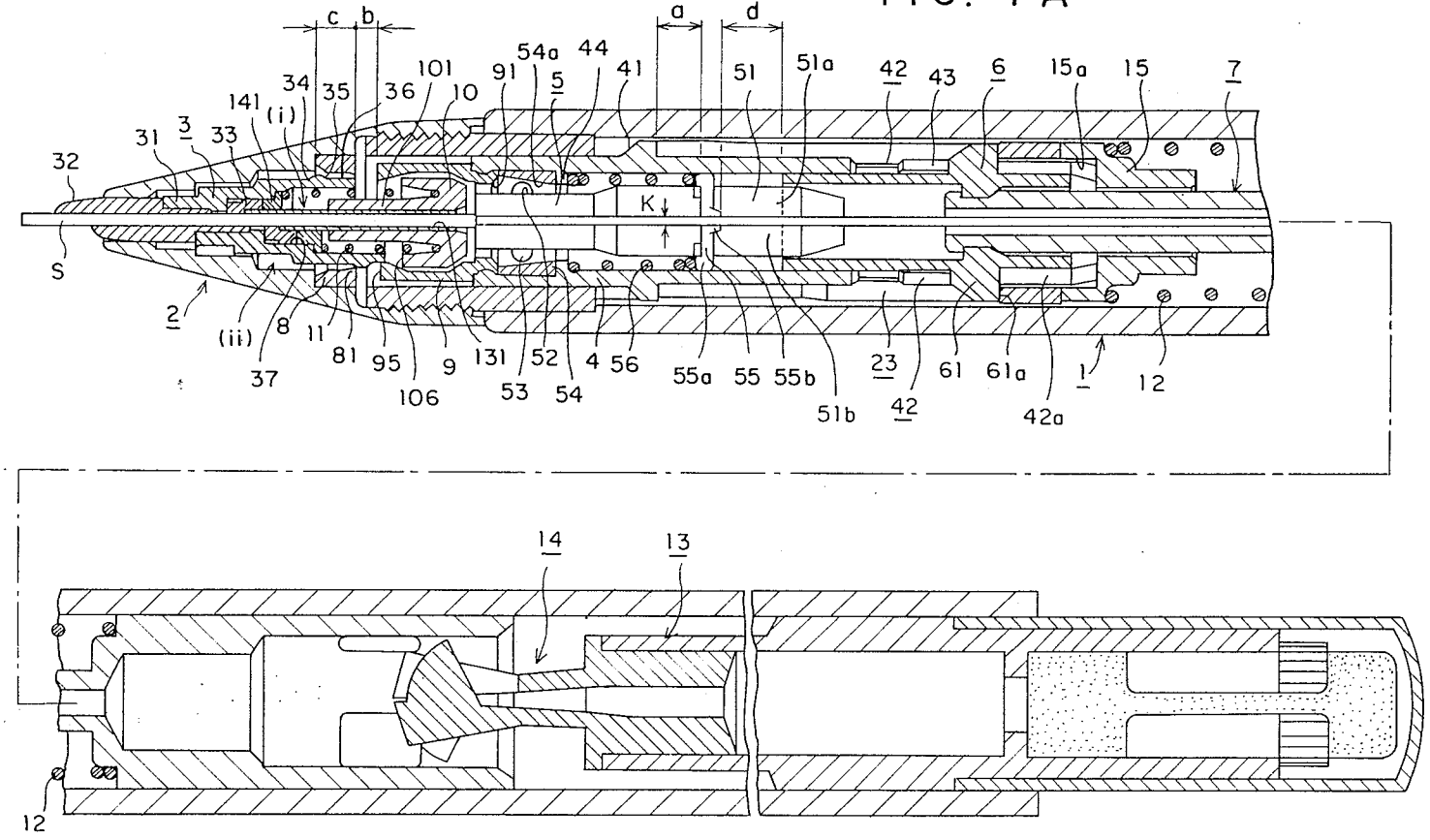
FIG. 1A is a longitudinal section of a mechanical pencil to which one preferred embodiment of the present invention is applied.

Referring now to the drawings, one preferred embodiment of the present invention will be described.

FIG. 1 is a sectional view for showing a mechanical pencil to which the present invention is applied. It is comprised of a tip element 2 removably attached to an extremity end of an outer cylinder 1, a slider 3 slidably stored axially within the tip element 2, a sleeve 4 slidably arranged axially in the tip element 2, a lead feeding mechanism installed within the sleeve 4, a stopper 6 slidable axially within a rear part of the sleeve 4, and a coupler 7 fitted and connected within the stopper 6.

Figure 2:
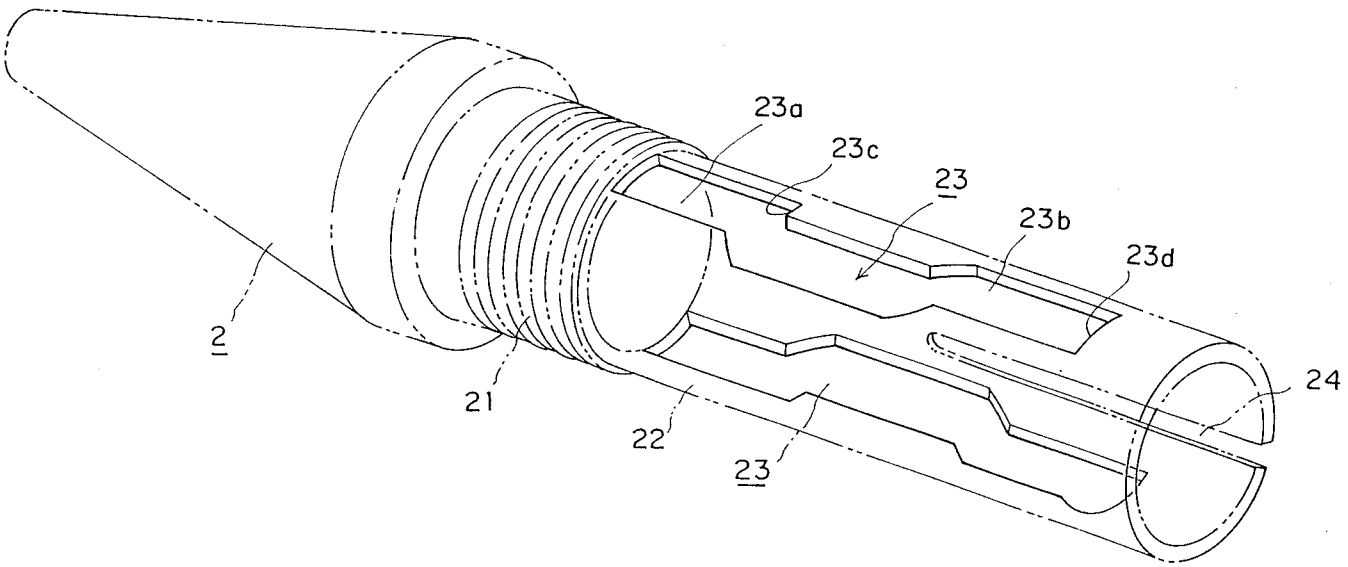
FIG. 2 is an illustrative perspective view for showing a sliding groove in a tip element.

The above-described tip element 2 has, as shown in FIGS. 1(A) and (B) and 2, a fitted part 21 with an external cylinder 1 and a rear cylinder 22 cooperatively arranged at a rear end of the fitted part 21. As shown in FIG. 2, the rear cylinder 22 is provided with a pair of symmetrical sliding grooves 23 and a slit 24 for making a positive end deformation in a diametrical direction of the rear end cylinder 22.

As shown in FIGS. 1(A), (B) and 2, the pair of sliding grooves 23 are formed of a crank shape and in a symmetrical shape axially and are provided with a sleeve-like projecting sliding groove **23*a* in which a sleeve projection 41 to be described later is slid, a stopper projecting sliding groove 23*a* in which a stopper projection 61 slides, and a sleeve retracting restricting step 23*c* formed at a rear end of the sleeve projecting sliding groove 23*a*. The sleeve retracting restricting step 23*c* may act to restrict a retracting movement of the sleeve projection 41** retracted under a knocking action at the rear end of the pencil to be described later or an excessive writing pressure dampening action.

In turn, to the inner wall of the tip element 2 is fitted an annular slider receiving part 8 as shown in FIGS. 1(A) and (B) and to the inner side at the rear end of the slider receiving part 8 is projected inwardly an annular slider stopper 81 detachably engaging with the slider 3.

As shown in FIGS. 1(A) and (B), the slider 3 is provided with a slider main body 31, a sliding tip 32 to be inserted and fitted to the extremity end of the slider main body 31 and a friction applying member 33 fitted inside the slider main body 31 and supplying a desired frictional force (for example, 13 to 20 g) to a lead S. Then, a rear part of the slider main body 31 is formed with a plurality of (four in the preferred embodiment) engaging pieces 34 which is detachably engaged with the slider stopper 81 and resiliently deformable in its diametral direction in separated form. Each of the engaging pieces 34 is formed with an engaging projection 35 engaging with or disengaging from the slider stopper 81, an engaging concave part 36 engaged with an extremity end engaging part 96 of a barrel ring 9 when locked and stored and an inclined surface 36a.

Within the slider 3 is fixed a lead guide pipe 131 for use in preventing a breakage of the lead S.

As shown in FIGS. 1(A) and (B), to the lead guide pipe 131 is press fitted a metallic pipe supporting part 14 having a flange part 14a, for example, and then the pipe supporting part 141 is rigidly fitted and supported to a fitted inner wall 37 of the slider 3. This lead guide pipe 131 is press fitted to a large inner diameter 33a of a friction applying member 33. So, the lead guide pipe 131 is kept at a condition in which it is forcedly fitted to the slider 3. An inner diameter of the lead guide pipe 131 is formed to show about 0.65 mm in a mechanical pencil for a lead with a diameter of 0.5 mm. An inner diameter of the projecting lever 10 to be described later is formed to have a value of about 0.9 mm for example. So, a desired spacing or clearance is formed between the lead guide pipe 131 and the projecting lever 10 in such a way as they may be freely slid to each other.

As described above, in the mechanical pencil of the present invention, since the lead guide pipe 131 for covering the lead S is arranged between the slider 3 and the projecting bar 10, the lead between the lead chuck 51 and the sliding tip 32 of the slider 3 can be covered with the slider 3, the lead guide pipe 131 and the projecting bar 10, resulting in that even if an external force more than the desired force is applied to the lead S, it is possible to prevent a breakage of the lead and at the same time to prevent a positive lead clogging caused by broken lead. In addition, a residue of lead is also discharged out of the pencil every time the lead is fed out through the sliding tip 32 without entering the lead feeding mechanism (5).

In the preferred embodiment described above, although the pipe supporting part 141 is described to be metallic, any type of material can be used if it may fix the lead guide pipe 131 rigidly and stably to the slider 3.

Figure 1C:
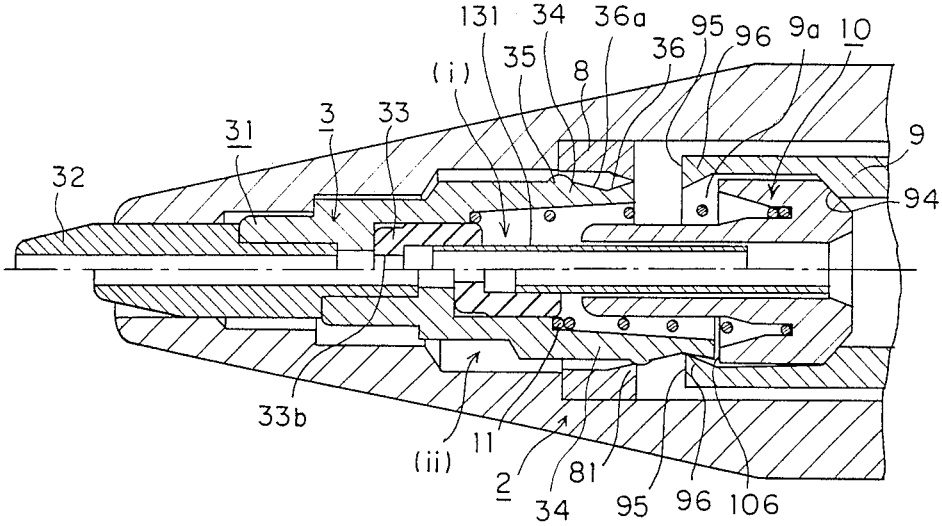
FIG. 1C is a longitudinal section for showing a substantial part of another preferred embodiment of the present invention.

FIG. 1(C) illustrates another preferred embodiment of a supporting structure for the lead guide pipe 131. In this preferred embodiment, the above-described pipe supporting structure 141 is eliminated and the lead guide pipe 131 is rigidly fitted and supported by the friction applying part 33. In this case, a desired clearance is formed between the extremity end of the lead guide pipe 131 and a friction applying member 33b of the friction applying member 33 and is formed in such a way as it may provide a desired frictional force to the lead S without applying any influence through the friction applying part 33.

Figure 1B:
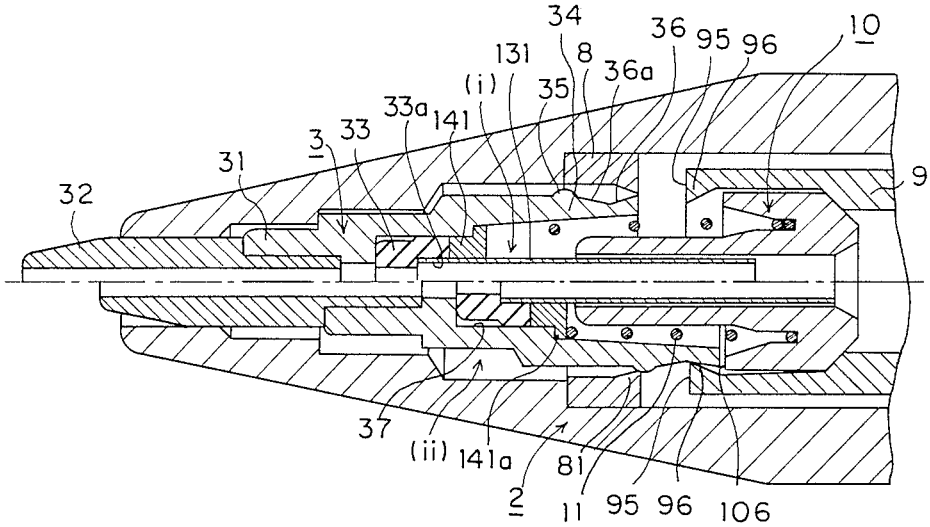
FIG. 1B is a longitudinal section for showing a substantial part of the mechanical pencil.

In FIG. 1, the slider 3 and the upper half part of the projecting bar 10 to be described later [illustrated in FIG. 1(A)(i), FIG. 1(B)(i) and FIG. 1(C)(i) illustrate a longitudinal section of them in case that any special external force is not applied when a writing operation is not performed and in turn, its lower half part [illustrated in FIG. 1(A), FIG. 1(B)(ii) and FIG. 1(C) (ii)] shows a longitudinal section when they are locked as described later.

Then, the sleeve 4 is axially and slidably arranged within the tip element 2.

The sleeve 4 is arranged as shown in FIGS. 1(A) to (C) such that the projecting bar 10 is arranged at its front end through a barrel ring 9, the lead feeding mechanism 5 is arranged in it, a coupler 7 is engaged with its rear end and a stopper 6 which can be axially slid is arranged, respectively.

The barrel ring 9 is fitted to an extremity end of the sleeve 4 and may act to perform some functions of holding the projecting bar 10 movably in it; storing a part near a rear end of the slider 3 when the slider 3 is locked and stored and engaging through the engaging concave part 36 and preventing a dropping of ball 53 to be described later at a rear stepped part 91. The extremity end of the barrel ring 9 is formed with at least more than axial slits (not shown) for performing a positive internal storing of the projecting bar 10 and a storing of a part near the rear end of the slider 3.

A reference numeral 95 denotes an extremity end wall part, and as described later, it may perform functions to press and abut against the rear end of the slider 3 when an extremity end of the pencil is knocked so as to release a locked state and to release a locked storing of the slider 3. A reference numeral 96 denotes the above-described extremity end engagement part.

A distance (b) is located between the extremity end (an extremity end wall part) 95 of the barrel ring 9 and the rear end of the slider receiving part 8. This distance (b) corresponds to a lead feeding amount and an automatic continuous writing enabling distance when the rear end is knocked and the extremity end is knocked, respectively.

In case of the above-described normal condition, as shown in FIG. 1(A), (a) a distance (b) is provided between the rear end of the slider 3 and the rear end of the slider receiving part 8, and between it and the extremity end wall part 95 of the barrel ring 9. This distance (b) corresponds to a lead feeding amount in case of knocking at the rear end and a knocking at the extremity end, and also a so-called automatic writing enabling range; (b) a distance (c) is arranged as a retracting distance to cause the engaging projection 35 of the slider 3 to be engaged with the slider stopper 81.

In addition, between the projecting slider 10 and the slider 3 is arranged a first resilient member 11 (for example, having a resilient force of 10 g to 12 g in case of compressing by a desired distance). This first resilient member 11 is stored in the slider 3 and externally arranged at a cylinder part 101 of the projecting bar 10 so as to enforce the slider 3 forwardly and at the same enforces the projecting bar 10 and its rearward sleeve 4 and the like rearwardly.

A cylinder part 101 of the projecting bar 10 extends axially and longitudinally to cover the lead S as much as possible and to prevent a breakage of the lead and at the same time to prevent some residues of lead and broken lead from being entered into the lead chuck 51 and further to engage with the rear end of the first resilient member 11.

As described above, in addition to the projecting bar 10 having the lead S covered therein, a lead guide pipe 131 for exposing the lead S as much as possible is further arranged between the slider 3 and the projecting bar 10, so that a lead clogging or an entering of lead residues or broken lead into the lead chuck 51 may positively be prevented.

Then, the lead feeding mechanism 5 arranged within the sleeve 4 will be described.

The lead feeding mechanism 5 includes a lead chuck 51 divided into two segments, a ball 53 held at a ball holding part 52 at a head part of the lead chuck 51, a metallic cylinder 54 provided with an inner tapered wall 54a fitted in an inner part of the extremity end of the sleeve 4 as required and for fitting and holding the ball 53 between the inner part of the extremity end and the ball holding part 52, and a second resilient member 56 for performing a chuck fastening resiliently installed between the inner wall stepped part 44 of the sleeve 4 and the engaging stepped part 55 of the lead chuck 51.

In this case, the second resilient member 56 has a weaker resilient force than that of the first resilient member 11.

The stopper 6 arranged at the rear end of the sleeve 4 has a pair of stopper projections 61 at its upper part and lower part, as shown in FIG. 1(A) and passes through an extremity end of the coupler 7 and is engaged with it. The stopper projections 61 have functions to be abutted against and engaged with a stopper projection engaging wall 23*d* of the tip element 2 (see FIG. 2) under a biasing force in a retracting direction of the third resilient member 12 and as described later, to make a unit block of each of the blocked tip element 2, sleeve 4 and coupler 7 as one unit; and to be slidably engaged with the sliding groove 42*a* of the sleeve 4 and the friction step 43 when the rear end is knocked and to advance the sleeve 4 only by an amount of desired distance.

The extremity end of the lead pipe 13 is provided with a chuck opening or closing mechanism 14 as described above.

Between the coupler 7 and the tip element 2 is resiliently fitted the third resilient member 12 through a receiving part 15. The third resilient member 12 has functions to return an advancing direction of the sleeve 4, lead feeding mechanism 5 and projecting bar 10 when the knocking operation is carried out at the extremity end, to return a retracting direction of the coupler 7 and the lead pipe 13 when the knocking act is performed at the rear end and to perform an excessive writing pressure dampening function during writing operation (for example, 370 g to 400 g).

The receiving part 15 receiving the extremity end of the third resilient member 12 is abutted, at its extremity end, against the rear end of the tip element 2 and the rear end of the sleeve 4 and then enables the above-mentioned three functions to be performed with the third one resilient member 12 through this abutment.

In case of performing an abutment with the rear end of the sleeve 4, as shown in FIG. 1(A), since the receiving part 15 pushes the rear end of the sleeve 4 with the inner wall hole 15*a*, the rear end of the sleeve 4 is reduced in its diametral direction so as to make a quite rigid state of the rear end of the sleeve 4 having the slit 24 (see FIG. 2).

Now, a relation of force will be arranged for a biasing force A of the first resilient member 11 and a frictional force B for the lead S through the friction applying member 33. The relation of both forces can be expressed by an inequality of $B>A$.

This is due to the fact that in case of performing the knocking action at the extremity end to be described later, if the relation above is not fulfilled, a lead sliding might occur between the friction applying member 33 and the lead S.

Further, the above-described distances (a), (c) and (d) have a relation of $d>a>c$.

An assembling work of the mechanical pencil of the present invention will be described.

At first, an assembling of the lead feeding mechanism 5 into the sleeve 4 will be described. That is to say, the chuck members 51*a* and 51*b* are assembled to each other and a second resilient member 56 is freely fitted to its outer circumference. In turn, a metallic cylinder 54 is press fitted to the inner wall part of the sleeve 4 in advance. Then, the chuck members 51*a* and 51*b* having the above-described second resilient member 56 freely fitted therein are inserted into the rear part of the sleeve 4. Then, the chuck members 51*a* and 51*b* are press fitted from the rear part to compress the second resilient member 56. After the ball 53 is inserted into the ball holding part 52 of the chuck members 51*a* and 51*b*, the depressing pressure is released and then the ball 53 is positively set in the ball holding part 52. Thereafter, the barrel ring 9 is press fitted into the extremity end of the sleeve. In this case, within the barrel ring 9 is stored in advance the projecting bar 10 engaged with the first resilient member 11.

Through this series of assembling operation, the sleeve 4, lead feeding mechanism 5, barrel ring 9, projecting bar 10 and first resilient member 11 are made as one block.

In turn, within the tip member 2 are assembled the slider receiving part 8 and the slider 3 assembled in advance and then the tip element 2 is made as a block.

The third resilient member 12 and the resilient member receiving part 15 are set in the coupler 7 in advance and lastly the stopper 6 is engaged to be made as a block. In this case, the stopper 6 may provide a biasing force under a biasing force of the third resilient member 12 through the passed and engaged coupler 7 and receiving part 15.

Then, an operation to make a unit of each of the blocked tip member 2, sleeve 4 and coupler 7 other than the outer cylinder 1 will be described. This operation to make a unit of each of the members is performed such that at first the blocked sleeve 4 is inserted from the rear end of the blocked tip member 2. Though this insertion work, the sleeve projection 41 of the sleeve 4 is engaged with the sleeve projection sliding groove 23*a* as shown in FIG. 1(A), resulting in that a pair of sliding grooves 23 of the tip member 2 and a pair of friction sliding grooves 42 of the sleeve 4 are located at their specified positions.

Then, the blocked coupler 7 is inserted from the rear end of the tip member 2 and the rear end of the sleeve 4. This insertion is carried out such that the stopper projection 61 of the stopper 6 at the extremity end of the coupler 7 is engaged within the sliding groove 23 of the tip member 2 and in the frictional sliding groove 42 of the sleeve 4.

In this case, the stopper 6 is, as described above, biased by the third resilient member 12, so that as shown in FIG. 1(A), the rear wall part 61*a* of the stopper projection 61 is forcedly engaged with the stopper projecting engaging wall part 23*d* of the sliding groove 23 of the tip member 2. With this arrangement, each of the blocked tip member 2, sleeve 4 and coupler 7 is made as one unit and can be handled as one unit block.

Lastly, if the unit block is inserted and fitted from the extremity end of the external cylinder 1 and then the lead pipe 13 is inserted and fitted from the rear end of the external cylinder 1 into the coupler 7, an assembling work of the mechanical pencil is completed.

Then, a lead feeding operation of the present invention will be described later.

This lead feeding operation can be classified into three functions of a knocking at the rear end (a first means), an automatic writing (a second means) and a knocking at the extremity end (a third means).

In this case, for a convenience of description, a case of performing an automatic writing operation of the second means will be described.

(1) The automatic writing operation as the second means is an automatic lead feeding operation which is carried out by interrupting the writing operation.

Figure 3:
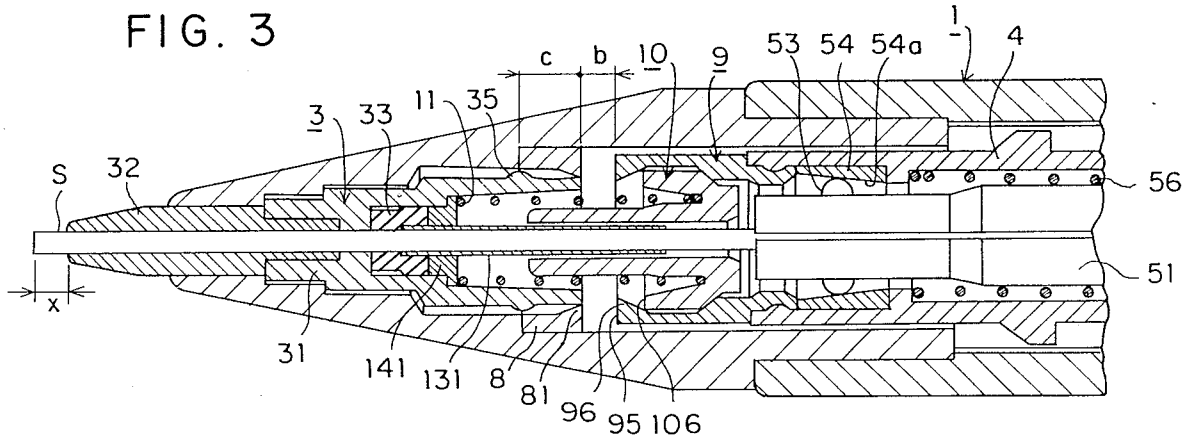
FIGS. 3 to 7 are an illustrative view for showing a lead feeding operation and a locking operation.
Figure 4:
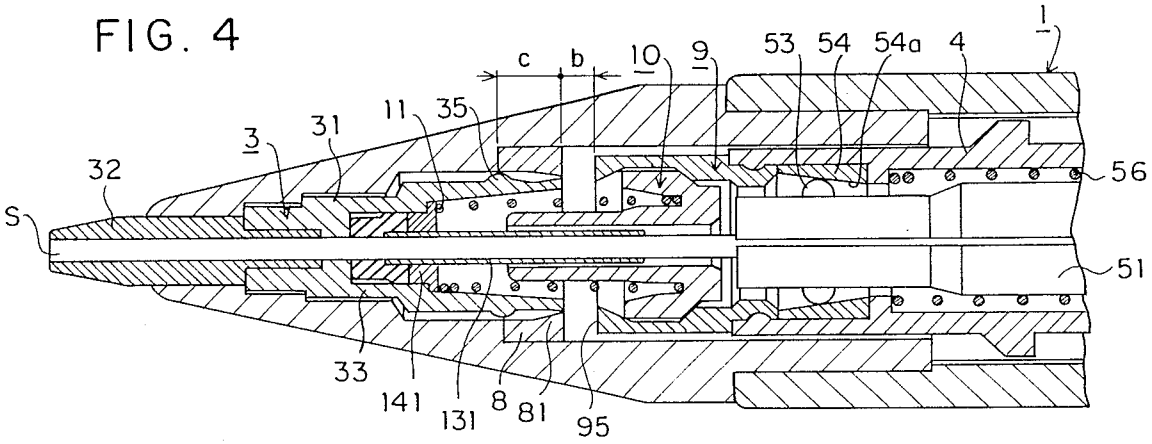

That is, the writing is carried out while the lead S is being projected from the sliding tip 32 by a desired amount X as shown in FIG. 3. As the writing operation proceeds, the lead S is worn in sequence to become in flush with the extremity end of the sliding tip 32 as shown in FIG. 4. Even under this condition, the slider 3 can be retracted against the biasing force of the first resilient member 11 toward the rear part, so that it can be moved by a distance where it may abut against the pressing wall part 95 of the barrel ring 9 as much as possible, that is to say, a retracting distance (b) shown in FIGS. 1 and 4. Then, the writing is interrupted while the slider 3 is retracted and then the extremity end of the sliding tip 32 is removed away from the sheet surface. The first resilient member 11 may advance the slider 3 and at the same time advance the lead S together with the slider 3 through a desired frictional force applied from the friction applying member 33. Through this series of operation, the assembly is returned back again to the state shown in FIG. 4, a lead is automatically fed to enable a writing to be performed and thus a continuous writing act may be carried out up to the retracted distance (b) of the slider 3 as much as possible.

(2) Then, the knocking operation at the rear end is normal means carried out through a knocking act at the rear end of the lead pipe 3.

That is, under a condition shown in FIG. 1(A), when the rear end of the lead pipe 13 is knocked, the coupler 7 may advance while compressing the third resilient member 12. In this case, the stopper 6 at the extremity end of the coupler 7 is engaged under a frictional force of the frictional stepped part 43 of the sliding groove **42*b* of the sleeve 4, so that the entire sleeve 4 blocked, that is, the sleeve 4, lead feeding mechanism 5, barrel ring 9 and projecting bar 10 advance together with the coupler 7 and they may advance until the extremity end of the barrel ring 9 may abut against the rear end of the slider receiving part 8. That is to say, they are made integral to each other and may advance by a distance (b) between the extremity end of the barrel ring 9 and the slider receiving part 8. This distance (b) becomes a lead feeding amount. The lead pipe 13, coupler 7 and stopper 6 are pushed further in a forward direction, the stopper projection 61 rides over the friction stepped part 43 of the sleeve 4 and then only the stopper 6, coupler 7 and lead pipe 13 may advance. Then, the extremity end of the stopper 6 is abutted against the stopper abutting projection 55*b* of the lead chuck 51 and engaged with it to cause the lead chuck 51 to be pressed forwardly against the biasing force of the second resilient member 56 engaged with the spring engaging projection 55*a***. During this advancing process, a releasing lever action is performed to release the held lead S and a repeating of the above-described operation may perform a normal lead feeding operation.

(3) The third means is a lead feeding operation through a knocking at the extremity end in which the extremity end of the slider 3 is pushed against the sheet surface. That is, as shown in FIG. 4, this is the case in which the lead feeding is carried out while the lead S is not projected out of the extremity end of the sliding tip 32 and then a condition in which the lead S is projected by a length of the distance (b) from the sliding tip 32 (X=b) can always be attained by knocking at the extremity end.

Through the knocking at the extremity end, the slider 3 is retracted with a reaction force of the pressing from the sheet surface and at the same time the above-described blocked sleeve (i.e. sleeve 4, lead feeding mechanism 5, barrel ring 9 and projection bar 10) and the receiving part 15 may retract against a biasing force of the third resilient member 12 and a frictional force generated between the stopper projection 61 and the frictional step 43 of the sleeve 4. This is due to the fact that the lead chuck 51 may retract while biting against the lead S, thereby the entire blocked sleeve and the receiving part 15 may receive an external force in its retracting direction. In this case, an amount of retraction of the sleeve 4 blocked with the slider 3 and an amount of retraction of the receiving part 15 are the same as each other and have a relation of distance of $a<d$ and so as shown in FIG. 1(A), it is the distance (a) where the sleeve 4 may retract as much as possible [a distance where the sleeve projection 41 is restricted for its retracting movement by the sleeve retracting limiting step **23*c* (see FIG. 2**)].

Figure 6:
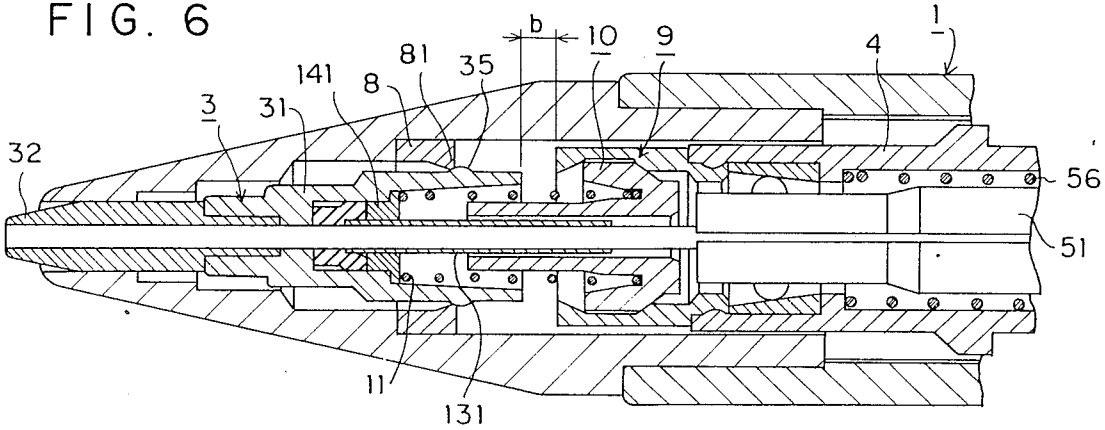

In turn, in case of retracting the slider 3, since the distances (d), (a) and (c) have a relation of $d>a>c$, at first the engaging projection 35 of the main body 31 of the slider rides over the slider stopper 81 of the slider receiving part 8 during a process in which it may retract by a retracting distance (a) of the maximum retracting distance described above, thereafter the rear end of the slider main body 31 is projected out of the rear end of the slider receiving part 8 as shown in FIG. 6.

In this case, as described above, the slider 3 and the blocked sleeve 4 are integrally retracted between the rear end of the slider main body 31 and the barrel ring 9 (an extremity end wall part) 95, so that the distance (b) is kept as shown in FIG. 6.

Then, as the slider 3 is moved away from the sheet surface to which it presses, the blocked sleeve 4 and the receiving part 15 advance until the extremity end of the receiving part 15 may abut against the rear end of the tip member 2 under a biasing force of the third resilient member 12. During this advancing movement, the lead chuck 51 may hold the lead S in its engaged condition. In case of performing this advancing movement, since the forward biasing force of the third resilient member 12 is set, as described above, higher than a rearward biasing force of the first resilient member 11 and the frictional force generated between the stopper projection 61 and the frictional step 43, the above-described advancement is carried out against these opposing external forces.

Figure 5:
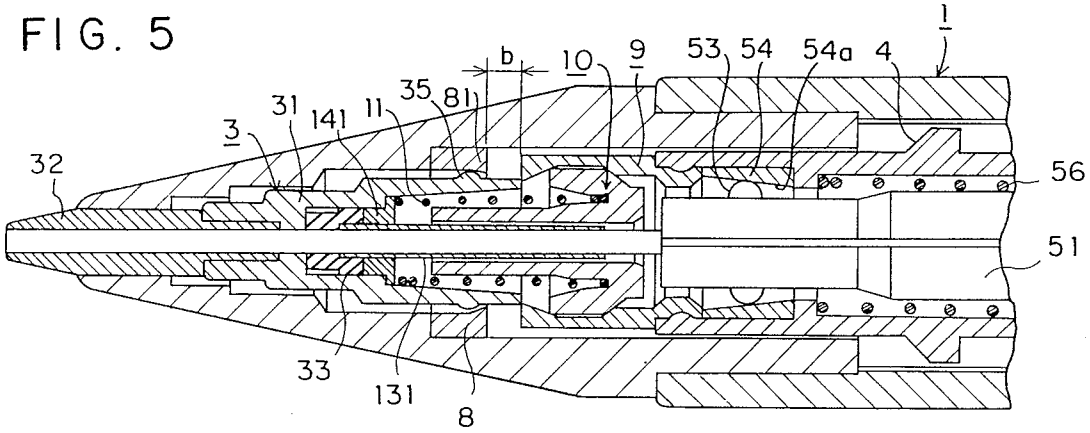

In turn, although the slider 3 advances under a forward biasing force of the first resilient member 11, it is stopped temporarily as shown in FIG. 5 by the engaging projection 35 of the slider main body 31 engaged with the slider stopper 81 of the slider receiving part 8. Even in case that the slider 3 is stopped temporarily, as described above, the lead feeding mechanism 5 may advance while engaging with the lead S, resulting it that the extremity end wall part 95 of the barrel ring 9 is abutted against the rear end of the slider main body 31 and then the lead S may advance against the slider 3 until the above-described temporary stopped engagement is released. This amount of advancement is equal to the distance (b).

Thus, the pencil becomes a condition shown in FIG. 3 (X=b) through the first knocking action at the extremity end and the lead S is protruded by length from the front end of the slide chip 32.

Figure 7:
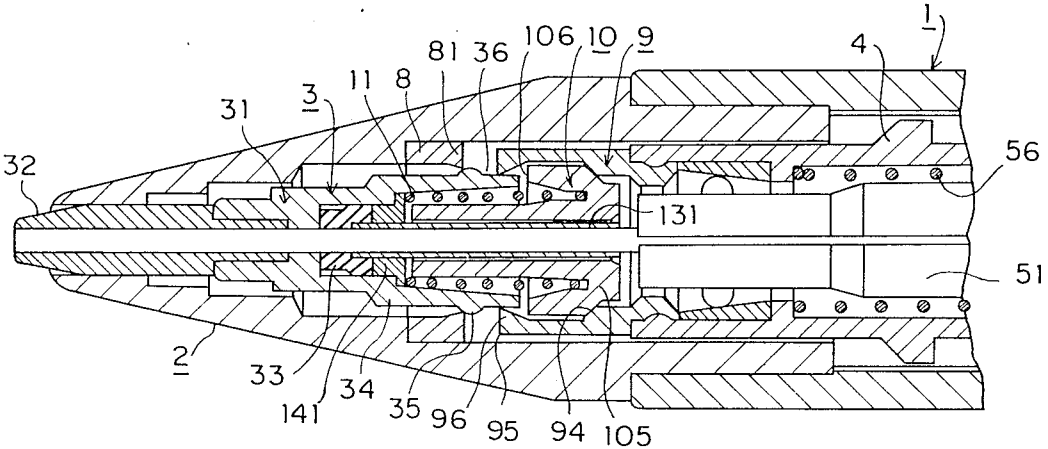

Referring now to FIGS. 1(A) and 7, a locked storing operation for the slider 3 of the mechanical pencil of the present invention will be described.

The rear end of the lead pipe 13 is knocked (a knocking at the rear end) from a condition in which the slider 3 is not locked, and then in this case the lead chuck 51 may release the lead S. Thus, the blocked sleeve 4 does not move rearwardly as different from the knocking at the extremity end described above, and the sliding tip 32 is pressed against the sheet or the like. Through this operation, the slider 3 may retract while compressing the first resilient member 11. During this retracting process, the slider 3 is engaged with the slider stopper 81, a part near its rear end is stored within the barrel ring 9 and it is engaged with the extremity end engaging part 96 of the barrel ring 9.

In this case, although the above-described normal lead feeding operation is carried out by the knocking at the rear end, the extremity end of the lead chuck 51 may push the projection bar 10 forwardly and move it at its final stage. Through the forward movement of the projection bar 10, the slit (not shown) of the barrel ring 9 is expanded to cause an opening area of the extremity part of the barrel ring 9 to be expanded, resulting in that a part near the rear end of the retracted slider 3 to be smoothly stored in the barrel ring 9.

Accordingly, the storing of the slider 3 within the barrel ring 9 assures a locked storing space for the slider 3 and when the slider is locked and stored, a quite small sliding tip 32 is merely projected from the extremity end of the tip member 2 and so an efficient locking and storing of the slider 3 can be performed.

Then, a lock releasing action of the slider 3 and the lead feeding operation will be described.

The above-described lock releasing action and the lead feeding action may be carried out only with a knocking at the rear end. Performing the knocking at the rear end causes both the sleeve 4 and the lead feeding mechanism 5 to be advanced by a distance (b) together and the first resilient member 11 may also biase the slider 3 forwardly through a compressive resilient force, resulting in that the engagement between the engaging projection 35 of the slider 3 and the slider stopper 81, and the engagement between the extremity end engaging part 96 of the barrel ring 9 and the engaging concave part 36 of the slider 3 are released.

In this case, as means for releasing the above-described engagement, the extremity end wall part 106 of the projection bar 10 [see FIGS. 1(A) to (C)] may also be applied.

A slider pipe which is smaller in diameter and formed by a pushing pipe, for example, by a slider tip 32 of the slider 3 shown in FIGS. 1(A) to (C) is fitted to the extremity end of the slider main body 31 and it can be applied as a mechanical pencil for a drawing work or the like.

In the above-described preferred embodiment, an automatic mechanical pencil has been described, but it may not be restricted to this preferred embodiment. For example, in case of the knocking type mechanical pencil including a tip member fitted to an extremity end of the external cylinder, a lead pipe slidably arranged within the external cylinder, and a lead feeding mechanism arranged at an extremity end of the lead pipe, the lead guide pipe may be installed between the tip member and the lead chuck of the lead feeding mechanism to cover and protect the lead in a range from the tip member to the lead chuck so as to prevent a breakage of the lead and a clogging of the broken lead. In this case, the lead guide pipe is fixed to the tip member by the friction applying member within the tip element or the pipe supporting member.

In the knocking type mechanical pencil having a slider therein, the lead guide pipe is fixed to the slider and the lead is covered and protected in a range from the slider to the lead chuck so as to prevent a breakage of the lead and a clogging of broken lead.

As described above, according to the present invention, since the lead is covered and protected between the slider or the tip member and the lead chuck, the present invention has an effect that a breakage of the lead and a clogging of broken lead can be prevented and further the residue of worn lead can be discharged out of the pencil through the extremity end of the pencil every time the lead is fed.

What is claimed is:

1. A mechanical pencil comprising:

a tip member, having a longitudinal axis, coaxially arranged at a forward extremity end of an external cylinder having an axis;

an axially slidable sleeve slidably engaged and held within said external cylinder;

a projection bar arranged at a forward extremity end of said sleeve;

a lead feeding mechanism, disposed within said sleeve, for allowing a lead to advance forwardly but preventing said lead from retracting rearwardly;

an axially slidable slider disposed within said tip member;

an axially slidable lead guide pipe, having a rear end portion slidable inserted into said projection bar, for covering and protecting said lead;

a resilient member, resiliently fitted between said slider and said projection bar, for yieldably urging said slider and said projection bar in axially opposite directions; and a friction applying means, fixed within said slider, for applying a predetermined friction force to said lead and for fixing a front end portion of said lead guide pipe to said slider for axial movement of said lead guide pipe with said slider.

2. A mechanical pencil according to claim 1, wherein said friction applying means comprises a friction applying member, having a front friction applying portion and a rear friction applying portion, fitted in said slider for axial movement therewith, said front friction applying portion engaging said lead for application of said predetermined force thereto, said rear friction applying portion engaging said front end portion of said lead guide pipe for axial movement of said lead guide pipe with said slider, said rear friction applying portion being axially spaced from said front friction applying portion whereby said front end portion of said lead guide pipe is separated from said front friction applying portion by a predetermined clearance.

3. The mechanical pencil according to claim 1, wherein said friction applying means comprises a friction applying member and a pipe supporting member; said pipe supporting member press fitted to said front end portion of said lead guide pipe and said pipe supporting member rigidly fitted to and supported by said slider; said friction applying member fitted to said slider and applying said predetermined friction force to said lead.

* * * * *